US005232213A

United States Patent [19]

Parsons et al.

[11] Patent Number: 5,232,213

[45] Date of Patent: Aug. 3, 1993

[54] VACUUM BELT SHEET FEEDER DEVICE

[75] Inventors: Michael H. Parsons, Rochester; Gregory R. Jantsch, Macedon; Alan E. Rapkin, Fairport; James D. Shifley, Rochester, all of N.Y.

[73] Assignee: Eastman Kodak Company, Rochester, N.Y.

[21] Appl. No.: 925,003

[22] Filed: Aug. 5, 1992

[51] Int. Cl.[5] ..... B65H 3/12

[52] U.S. Cl. ..... 271/95; 414/797.2

[58] Field of Search ..... 271/95, 94, 106, 34, 271/112; 414/497.2, 497; 221/211

[56] References Cited

U.S. PATENT DOCUMENTS 3,193,282 7/1965 Stewart ..... 271/12
3,570,843 3/1971 Keulen et al. ..... 271/95
3,787,044 1/1974 Lorensen et al. ..... 271/27
3,847,383 11/1974 Wejtowicz et al. ..... 271/11
4,643,413 2/1987 Ward et al. ..... 271/95
5,090,676 2/1992 Matsuno et al. ..... 271/12

*Primary Examiner*—David H. Bollinger
*Attorney, Agent, or Firm*—Leonard W. Treash, Jr.

[57] ABSTRACT

In a sheet feeder device of the vacuum belt type, the vacuum belt moves in a pivotal manner between a generally horizontal sheet acquiring position, in which the lower face of the belt confronts the top surface of the top sheet, lying generally flat atop the underlying stack sheet; and a tilted position, in which the belt lifts the leading end of the acquired top sheet away from the underlying sheet, flexes it to insure its separation from the underlying sheet and delivers it endwise to a sheet receiving unit.

5 Claims, 3 Drawing Sheets

FIG. 3a
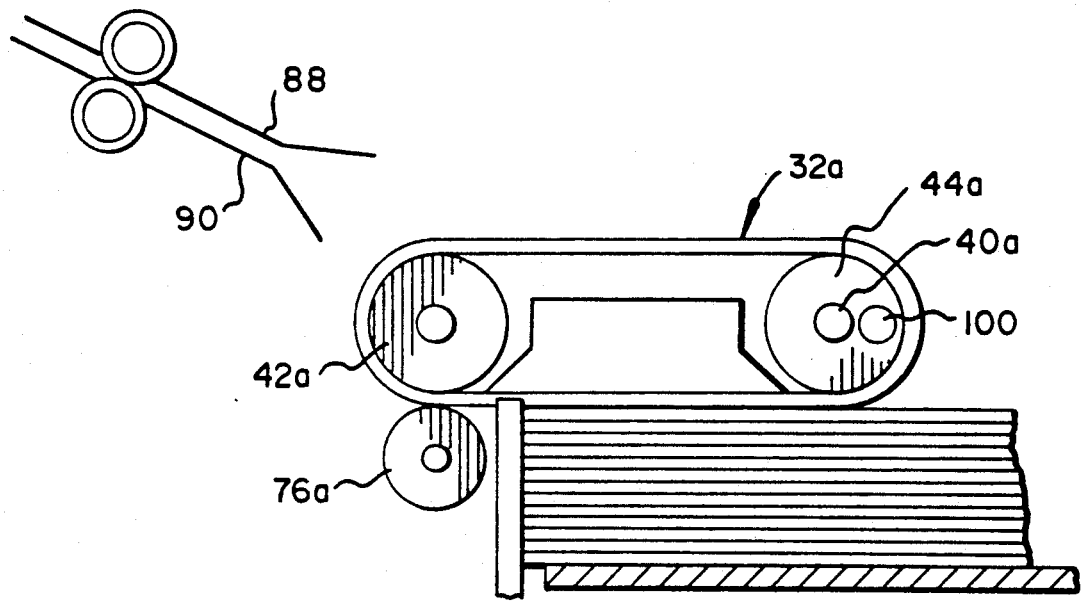
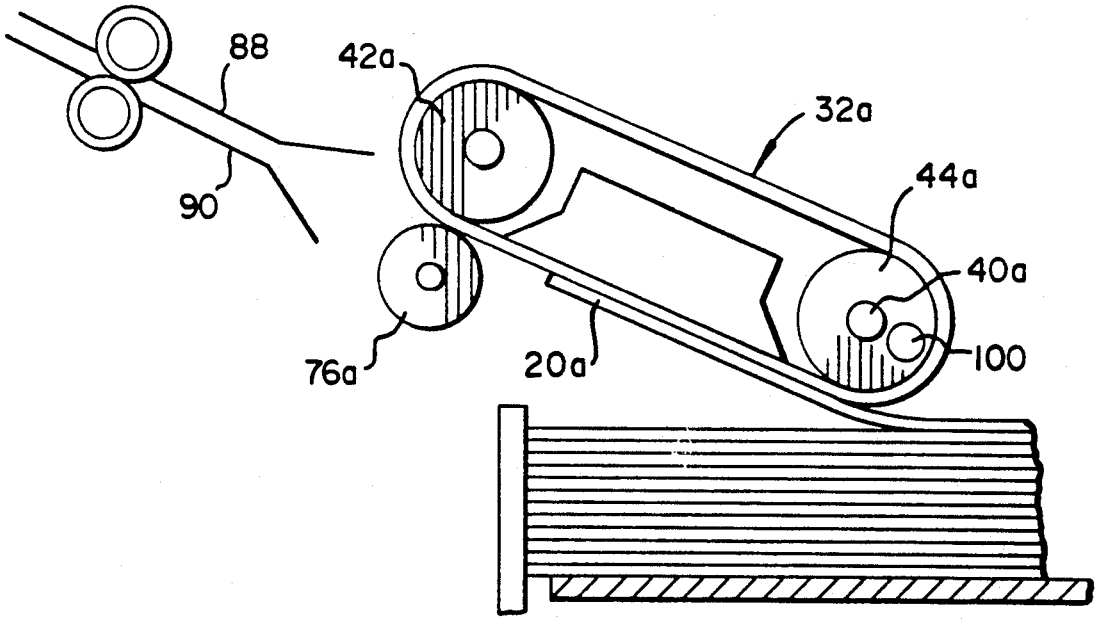
FIG. 3b

VACUUM BELT SHEET FEEDER DEVICE

BACKGROUND OF THE INVENTION

1. Field of the Invention

The present invention relates to an improved vacuum belt feeder device for feeding successive sheets of paper or the like endwise from the top of a stack of sheets. More particularly, the invention relates to such a device in which the vacuum belt moves in a pivotal manner between a generally horizontal sheet acquiring position and a tilted sheet delivery position, whereby the belt lifts the leading end of the top sheet away from the underlying sheet and also flexes the top sheet to insure its separation from the underlying sheet.

2. Description Relative to the Prior Art

Many devices have been developed in the past to feed successive sheets endwise from the top of a stack of sheets, for example, to deliver the sheets one-at-a-time to a printer or copier apparatus. The well known type of such device to which the present invention is directed employs an endless belt to which the top sheet is adhered by vacuum or suction so that orbital movement of the belt moves the sheet endwise. Preferably, the belt holds the leading edge of the top sheet away from the next lower sheet and it is also advantageous that the top sheet be flexed centrally of the stack to further insure the proper separation of that sheet from the underlying sheet.

The following prior art references disclose variation of the general type of sheet feeder device described above:

U.S. Pat. No. 5,090,676 discloses a sheet feeder in which a vacuum belt is located above the topmost sheet of a pile of sheets and that sheet is moved upwardly into contact with the belt by a jet of air blown against the leading edge of the stack. The belt is perforated only in a specific region and the vacuum is controlled by the position of the perforated belt region relative to a plenum chamber. No means are provided for flexing the top sheet except for a sensor device that would appear to be relatively ineffective from the standpoint of sheet separation because of its close proximity to the trailing end of the sheet.

U.S. Pat. No. 4,643,413 discloses a sheet feeder having a belt assembly comprising a plurality of spaced parallel belts located above a stack of paperboard sheets, with continuously evacuated suction chambers confronting the top sheet between the belts. The belt assembly is movable parallel to itself between lowered and raised positions. When the belt assembly is raised, it lifts the top sheet from the stack and the belt is then driven to move that sheet endwise into a nip between a pair of conveyor rolls. However, the sheet being transported is not flexed to insure its separation from the underlying sheet.

U.S. Pat. No. 3,847,383 discloses a sheet feeder in which a belt assembly with a plurality of perforated vacuum belts is mounted with the belts permanently in sloped relation to the uppermost sheet in the sheet stack. Considerable air flow is therefore required to provide enough vacuum to lift and flex the top sheet into contact with the belts, which is cyclically prevented by a movable finger. The flexure region of the top sheet is not established by the vacuum belts, but, rather, by a buffer plate that is located adjacent the rearward or trailing belt rollers or idlers.

U.S. Pat. No. 3,193,282 shows a device for feeding sheets off the bottom of a stack of sheets by means of a vacuum belt that shifts pivotally about the axis of one of the belt support rollers. However, the shifting of the belt does not move the engaged sheet away from the adjacent stack, but moves the belt from an operative position to a position beyond contact with the sheet with which it was engaged.

U.S. Pat. No. 3,787,044 discloses a device for feeding sheets off the top of a stack, wherein a suction roller is lowered into contact with the top sheet and is then raised and rotated to advance the sheet endwise. A spring finger tends to establish a flexure region in the sheet being advanced. The covering and uncovering of the suction openings in the roller controls the up-and-down and rotational movements of the roller.

SUMMARY OF THE INVENTION

The present invention provides a novel improved sheet feeder device of the vacuum belt type in which the vacuum belt moves in a pivotal manner between a generally horizontal sheet acquiring position in which the lower face of the belt confronts the top surface of the top sheet and a tilted position in which the belt lifts the leading end of the acquired top sheet away from the underlying sheet, flexes it to insure its separation from the underlying sheet and delivers it endwise to a sheet receiving unit.

In addition to being simple, reliable and relatively inexpensive, the novel sheet feeder device according to the present invention has the following specific advantages:

1. The vacuum belt moves to the top sheet, resulting in positive pickup with a relatively low flow rate, which allows the use of a relatively small vacuum pump or the like and eliminates the need to turn the vacuum on and off. This low flow rate also allows the feeder to be quieter, and to use less power.

2. No jets of air are used to separate the sheets, which also reduces noise and power consumption.

3. No vacuum valve is required, thus providing a cost saving and a gain in reliability.

4. The feeding motion is very simple and is not critical, thereby likewise resulting in cost savings and reliability improvement.

5. The portion of the belt that flexes the sheet moves in the same direction and at the same speed as the sheet while the latter is being delivered, and therefore, does not tend to frictionally retard the sheet delivery.

Various means for practicing the invention and other advantages and novel features thereof will be apparent from the following detailed description of illustrative preferred embodiments.

BRIEF DESCRIPTION OF THE DRAWINGS

FIGS. 3*a* and 3*b* correspond generally to the respective FIGS. 2*b* and 2*c*, but depict a second embodiment of the invention.

DETAILED DESCRIPTION OF THE PREFERRED EMBODIMENTS

Figure 1:
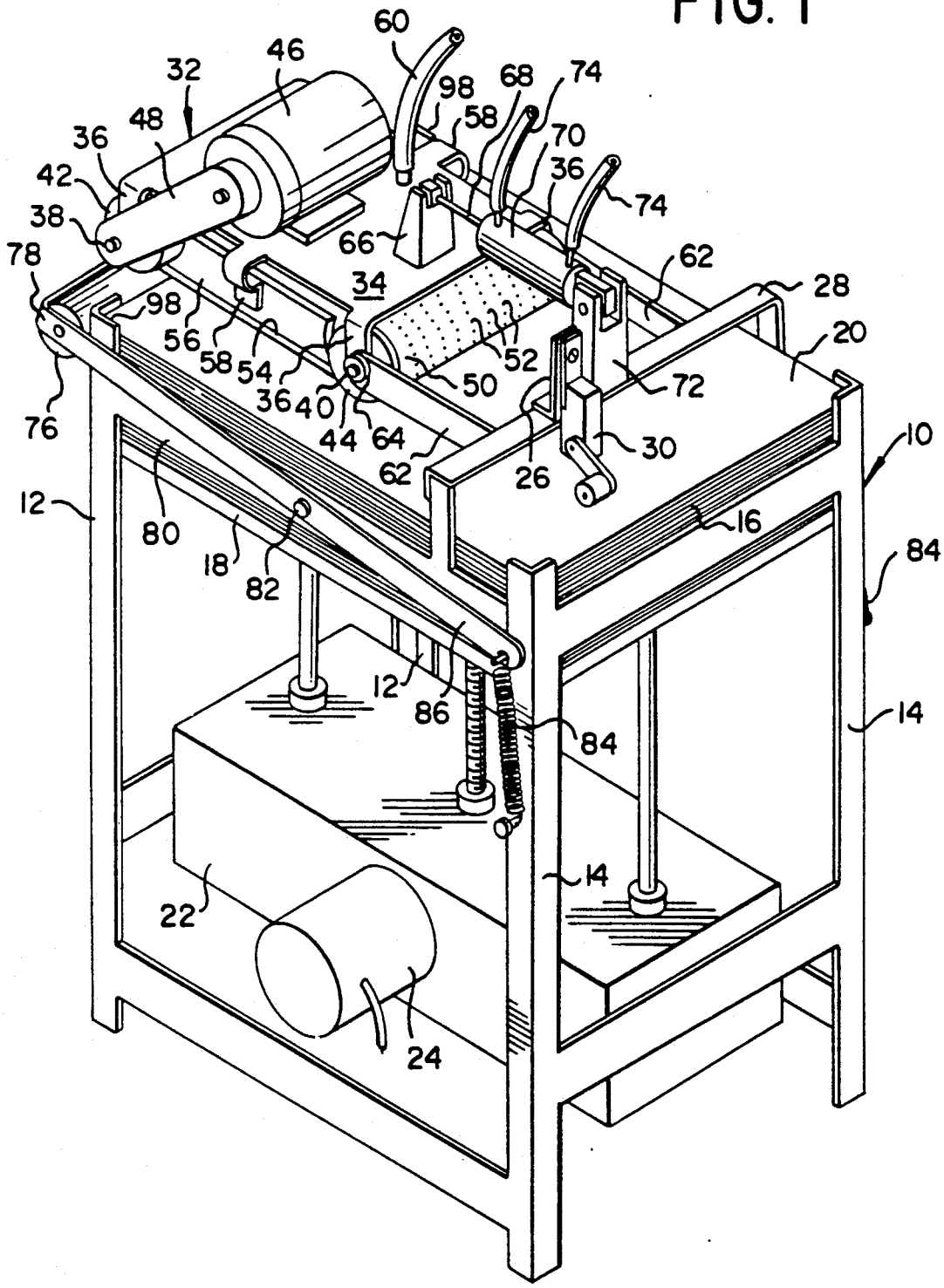
FIG. 1 is a somewhat schematic isometric view of a vacuum belt sheet feeder device according to a first illustrative embodiment of the present invention.

As best shown in FIG. 1, the first preferred embodiment of the invention comprises a frame 10 that includes front and rear angel corner guides 12 and 14 for a stack of sheets 16 lying on a platen 18, the top or uppermost sheet being designated by numeral 20. The platen, in turn, can be raised and lowered by an elevator mechanism, depicted as a screw jack type of device 22, driven by a reversible electric motor 24. A bracket 26 is mounted to cross bar 28 of frame 10 above the stack of sheets and carries a vertically adjustable sheet sensor switch 30 that controls motor 24 to maintain the top of the stack at a predetermined level, as is well known in the art.

The vacuum belt feeder unit 32 comprises a support plate 34 with depending ears 36 that are provided with bushings or bearings, not shown, that rotatably support the center shafts 38 and 40 of the respective; leading and trailing belt supporting rollers 42 and 44. The leading roller 42 is adapted to be driven by a gear reduction electric motor 46 mounted to plate 34 and connected to roller 42 by a gear belt or the like, not shown, which is enclosed in a housing 48. An endless flexible belt 50, provided with a pattern of perforations 52, is tensioned around rollers 42 and 44, with its inner lower surface 54 in contact with the open lower face of vacuum box 56. The vacuum box, in turn, is mounted to plate 34 by ears 58 and is connected to a vacuum pump or the like, not shown, by a flexible hose 60.

Figure 2A:
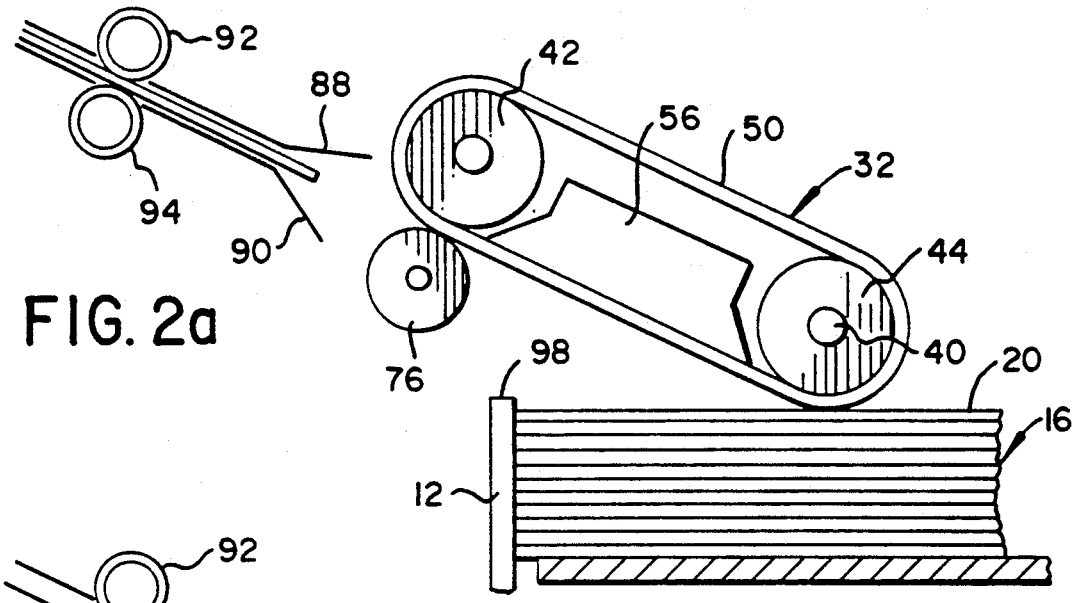
FIGS. 2*a*, 2*b* and 2*c* are schematic side views of the device shown in FIG. 1, depicting different stages of operation of the device.

A pair of support arms 62 extend from cross bar 28 of frame 10 and straddle the trailing end of the belt unit. The center shaft 40 of the trailing roller 44 is received in arm bushings 64, thereby supporting the belt unit for pivotal movement about the axis of shaft 40. A bracket 66 projects upwardly from support plate 34 and is connected to the piston rod 68 of an air cylinder 70 or the like, which is similarly connected to a bracket 72 attached to cross bar 28. By energizing air cylinder 70, by means of flexible air lines 74, the belt unit can by moved between its depicted generally horizontal position, in which the lower belt face is in close confronting relation to top sheet 20 of stack 16, as shown in FIGS. 1 and **2*b*, and a tilted position in which the leading roller is raised above the stack, as shown in FIGS. 2*a* and 2*c***. Either the air cylinder itself or other appropriate stop means, not shown, can be used to establish the two extreme positions of the belt unit.

Below the leading roller 42 of belt unit 32, an idler roller 76 is rotatably carried by a yoke member 78 pivoted to longitudinal bars 80 of frame 10 by studs 82. Springs 84, connected to extension arms 86 of yoke 78 and to frame 10 bias the idler roller upwardly toward leading belt roller 42.

FIG. **2*a* shows the feeder unit 32 and the idler roller 76 in the respective positions that they assume after a sheet has been delivered to a sheet receiving device depicted by guide members 88 and 90 and drive rollers 92 and 94. To feed the next sheet, the belt unit and the idler roll are moved by air cylinder 70 to the position shown in FIGS. 1 and 2*b*, whereby the leading end of the top sheet 20 is acquired, i.e., is adhered to the lower face of the vacuum belt. After the the sheet is acquired, cylinder 70 moves unit 32 to the position shown in FIG. 2*c*, and motor 46 is energized to drive roller 42 clockwise, as shown by arrow 96 in FIG. 2*c*. Accordingly, belt 50 raises the leading edge of the top sheet is above the upper sheet stop ends 98 of the front angle corner guides 12 of frame 10; and feeds the leading end of the sheet into the nip between the belt and idler roll 76, which helps guide the end of the sheet between guide members 88 and 90 and to drive rollers 92 and 94**. At the same time, the region of the belt adjacent the trailing roller flexes the portion of the top sheet near the center of the stack to ensure the separation of the top sheet from the underlying sheet. It should be noted that, if the top sheet were to be flexed upwardly by its engagement with a stationary member, e.g. as in the device shown in the previously mentioned '383 patent, friction between that member and the sheet would tend to resist endwise movement of the latter. However, this is not the case with the subject device, because the sheet being delivered is flexed by the vacuum belt, which moves in the same direction and at the same speed as the sheet itself.

Figure 2B:
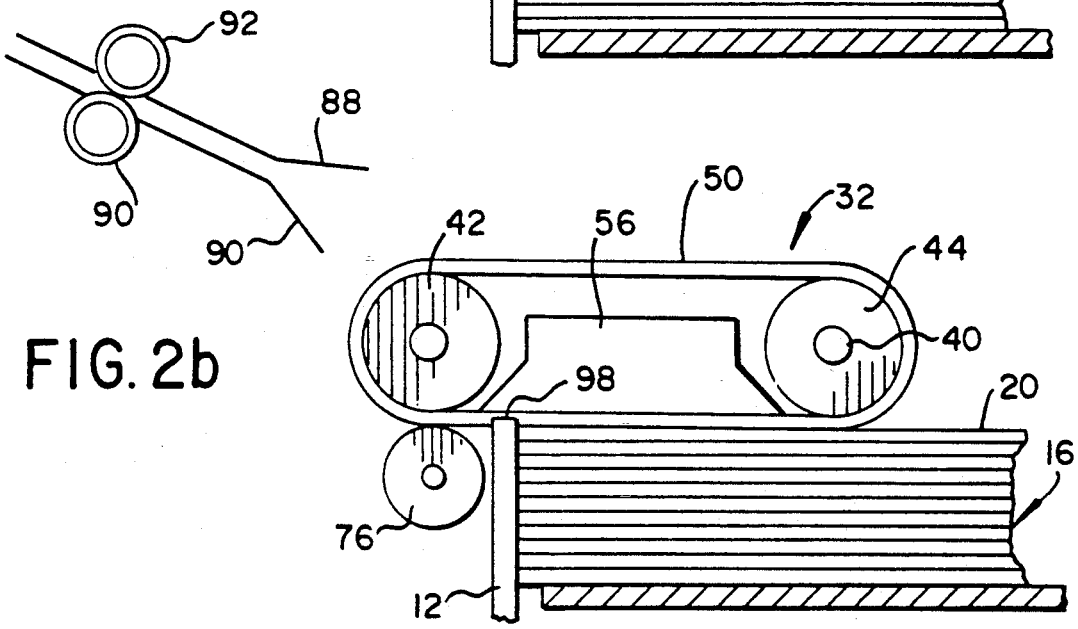
Figure 2C:
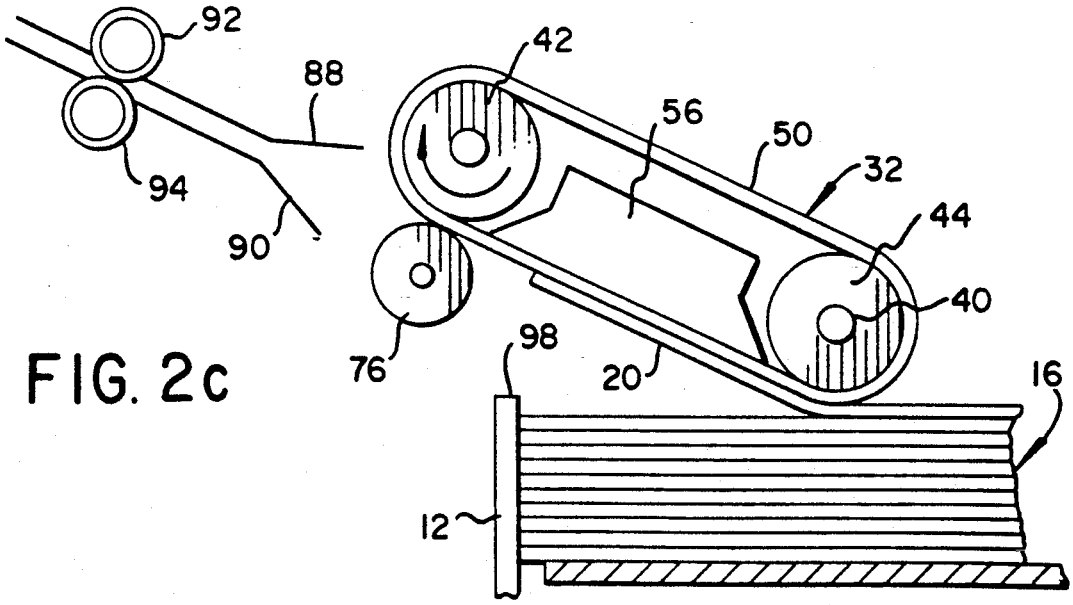

After the top sheet has been delivered beyond engagement with the feeder unit, the latter is again moved by cylinder 70 from the position shown in FIG. **2*a* to the position shown in FIGS. 1 and 2*b***, whereby the vacuum belt acquires the next available sheet.

As previously mentioned, because the lower face of the vacuum belt is in contact with or very close to the top sheet when the belt unit is in the position shown in FIGS. 1 and **2*b***, relatively little vacuum or suction is needed to insure that the belt will acquire the top sheet. Accordingly, the vacuum can remain turned on even when the belt is in the tilted position with no sheet covering its vacuum ports, without wasting excessive energy or creating excessive noise.

The embodiment of the invention shown in FIGS. **3*a* and 3*b* is basically identical to the one described above, except that the shaft or stud member 100 that define the pivot axis of feeder unit 32*a* are located somewhat rearwardly of the axis of the trailing roller shaft 40*a*. Consequently, when the vacuum belt unit 32*a* is moved to the position shown in FIG. 3*b*, the leading roller 42*a* and the idler roller 76*a* are raised to align the leading end of the sheet 20*a* with guide members 88 and 90; and the trailing roller 44*a*** also moves slightly upwardly, but by a relatively much smaller amount, to insure that the top sheet is not pressed downwardly against the underlying sheet by the trailing roller portion of the belt, which might otherwise retard its endwise movement.

The invention has been described in detail with particular reference to preferred embodiments thereof, but it will be understood that variations and modifications can be effected within the spirit and scope of the invention.

What is claimed is:

1. A sheet feeding apparatus for feeding successive top sheets endwise from a stack of sheets, said sheet feeding apparatus comprising:

a feeder assembly including;

an endless belt encircling at least two support rollers with an elongate lower belt section extending between said rollers, suction means for causing a portion of a sheet in contact with said lower belt section to adhere thereto, and drive means for driving said belt in a predetermined direction in which said lower belt section moves from a trailing one of said support rollers toward a leading one of said support rollers, support means supporting said assembly above said stack of sheets for movement between a first position in which said lower section of said belt is in closely confronting relation to one end of the generally flat top sheet of said stack of sheets whereby said one end of said sheet is adhered to said belt by said vacuum means and a second position in which said leading one of said rollers is raised further than is said trailing one of said rollers, whereby said one end of said top sheet adhered to said belt is separated from the corresponding portion of the underlying sheet and said top sheet is flexed by contact with the portion of said belt adjacent said trailing one of said rollers.

2. The invention of claim 1 including control means for energizing said drive means of said feeder assembly when said feeder assembly is in said second position to thereby feed said sheet adhered to said belt in an endwise direction away from said stack.

3. The invention of claim 1 including sheet stop means for preventing endwise movement of said top sheet while the latter is lying in generally flat condition on the underlying sheet of said stack, said leading end of said top sheet being raised above said stop means by said assembly when the latter is in said second position.

4. The invention of claim 1 including an idler roll rotatably supported below and parallel to said leading roller and means resiliently biasing said idler roll upwardly toward said leading roller to provide a nip between said idler roller and the corresponding region of said belt.

5. The invention of claim 1 in which said suction means operates continuously during operation of said sheet feeding apparatus.

* * * * *